US008157662B1

(12) United States Patent
McCoy et al.

(10) Patent No.: US 8,157,662 B1
(45) Date of Patent: Apr. 17, 2012

(54) BILLIARDS SYSTEMS

(76) Inventors: Donna L. McCoy, Black Canyon City, AZ (US); Glenn McCoy, Black Canyon City, AZ (US)

( * ) Notice: Subject to any disclaimer, the term of this patent is extended or adjusted under 35 U.S.C. 154(b) by 0 days.

(21) Appl. No.: 12/768,624

(22) Filed: Apr. 27, 2010

Related U.S. Application Data

(60) Provisional application No. 61/238,989, filed on Sep. 1, 2009.

(51) Int. Cl.
*A63D 15/00* (2006.01)

(52) U.S. Cl. ..... 473/24; 473/25; 473/18

(58) Field of Classification Search ..... 473/1, 4, 473/17, 18, 19, 29, 33, 22, 24, 25
See application file for complete search history.

(56) References Cited

U.S. PATENT DOCUMENTS

| | | | | |
|---|---|---|---|---|
| 857,057 | A * | 6/1907 | Haskell | 473/25 |
| 3,096,981 | A | 7/1963 | Fischer | |
| 3,497,048 | A | 2/1970 | Le Mieux et al. | |
| 3,797,627 | A | 3/1974 | Baker | |
| 3,985,355 | A | 10/1976 | Shoemaker | |
| 4,015,845 | A * | 4/1977 | Sines | 473/24 |
| 4,116,435 | A * | 9/1978 | Sines et al. | 473/24 |
| 4,193,596 | A * | 3/1980 | Baker | 473/24 |
| 4,378,114 | A | 3/1983 | Sargent | |
| 4,726,586 | A * | 2/1988 | Shelton et al. | 473/24 |
| 4,844,457 | A | 7/1989 | Webster | |
| 5,026,052 | A | 6/1991 | Shelnutt | |
| D374,471 | S | 10/1996 | Scott et al. | |
| 6,709,341 | B1 | 3/2004 | Giles | |
| 7,637,820 | B2 * | 12/2009 | Zecevic | 473/25 |

* cited by examiner

*Primary Examiner* — Mitra Aryanpour
(74) *Attorney, Agent, or Firm* — Stoneman Law Patent Group; Martin L. Stoneman; Eric Fish

(57) ABSTRACT

An L-shaped billiard table system comprising a pocket-specific ball return feature.

19 Claims, 3 Drawing Sheets

BILLIARDS SYSTEMS

CROSS-REFERENCE TO RELATED APPLICATION

The present application is related to and claims priority from to prior provisional application Ser. No. 61/238,989, filed Sep. 1, 2009, entitled "BILLIARDS SYSTEMS", the contents of which are incorporated herein by this reference and are not admitted to be prior art with respect to the present invention by the mention in this cross-reference section.

BACKGROUND

This invention relates to providing a system for enhanced billiards table systems. More particularly, this invention relates to a specialized billiards table especially useful in increasing the enjoyment of billiard and pool players during play.

Currently, millions of people worldwide actively play the game of billiards, also commonly known as pool. Billiards is a sporting game played by two or more people on a rectangular table having six openings. Numerous variations of the rules of billiards exist but in substantially all versions, a player must strike a first ball with a cue to an impact with a second ball that travels into one of the six openings. Most players eventually seek to increase their play enjoyment by learning the sport's many variations.

Clearly, systems that offer additional play variation and enhanced convenience during play would be of great value within this sport.

OBJECTS AND FEATURES OF THE INVENTION

A primary object and feature of the present invention is to provide a system for unique billiards play.

It is another primary object and feature of the present invention to provide such a system utilizing an automatic ball return feature having a plurality of ball-return points, each ball-return point located generally adjacent the region of the table in which the ball was pocketed.

It is a further object and feature of the present invention to provide such a system that utilizes a non-standard play-surface shape.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system related to billiard table constructions supporting billiards-type game play using at least one billiard ball, such system comprising: at least one playing surface, comprising at least one first playing-surface region and at least one second playing-surface region, such at least one first playing-surface region and such at least one second playing-surface region each structured and arranged to support the billiard-type game play using the at least one billiard ball; disposed about such at least one first playing-surface region, at least one first set of ball pockets structured and arranged to receive the at least one billiard ball; disposed about such at least one second playing-surface region, at least one second set of ball pockets structured and arranged to receive the at least one billiard ball; at least one first ball-return receptacle structured and arranged to hold the at least one billiard ball in at least one user-accessible position adjacent such at least one first playing-surface region; at least one second ball-return receptacle structured and arranged to hold the at least one billiard ball in at least one user-accessible position adjacent such at least one second playing-surface region; at least one first ball-return path structured and arranged to return the at least one billiard ball pocketed within such first set of ball pockets to such at least one first ball-return receptacle; and at least one second ball-return path structured and arranged to return the at least one billiard ball pocketed within such second set of ball pockets to such at least one second ball-return receptacle.

Moreover, it provides such a system further comprising: at least one third ball-return receptacle structured and arranged to hold the at least one billiard ball in at least one user-inaccessible position; wherein such at least one third ball-return receptacle comprises at least one controllable access structured and arranged to provide to the user, controllable access to the at least one billiard ball held within such at least one third ball-return receptacle. Additionally, it provides such a system wherein: such at least one billiard ball includes at least one cue-ball and at least one object-ball; such at least one first ball-return path and such at least one second ball-return path comprise at least one ball-separator structured and arranged to separate the at least one cue-ball from the at least one object-ball; and such at least one ball-separator comprises at least one object-ball diverter structured and arranged to divert the at least one object-ball to such at least one third ball-return receptacle.

Also, it provides such a system wherein: such at least one billiard ball includes at least one cue-ball and at least one object-ball; such at least one first ball-return path comprises at least one first junction structured and arranged to divide such at least one first ball-return path into at least one first cue-ball path communicating with such at least one first ball-return receptacle and at least one first object-ball path communicating with such at least one third ball-return receptacle; such at least one first junction comprises at least one first ball-diverter structured and arranged to divert the at least one cue-ball to such at least one first cue-ball path and the at least one object-ball to such at least one first object-ball path.

In addition, it provides such a system wherein: such at least one second ball-return path comprises at least one second junction structured and arranged to divide such at least one second ball-return path into at least one second cue-ball path communicating with such at least one first ball-return receptacle and at least one second object-ball path communicating with such at least one third ball-return receptacle; such at least one second junction comprises at least one second ball-diverter structured and arranged to divert the at least one cue-ball to such at least one second cue-ball path and the at least one object-ball to such at least one second object-ball path.

Additionally, it provides such a system wherein such at least one controllable access comprises at least one monetary acceptor structured and arranged to allow user access to the at least one object-ball on completion of at least one monetary exchange.

Further, it provides such a system wherein such at least one third ball-return receptacle comprises at least one capacity sufficient to hold at least fifteen of the at least one object-balls.

Even further, it provides such a system wherein: the at least one object-ball comprises an outer diameter smaller than the outer diameter of the at least one cue-ball; such at least one object-ball diverter comprises at least one ball-diameter gauge structured and arranged to divert the at least one object-ball by gauging the outer diameter of the at least one object-ball.

Moreover, it provides such a system wherein: the at least one cue-ball comprises at least one magnetic composition; the at least one object-ball comprises at least one substantially non-magnetic composition; such at least one object-ball diverter comprises at least one magnetic detector structured and arranged to detect the presence of the at least one magnetic composition; and such at least one magnetic detector is structured and arranged to pass the at least one cue-ball and to divert the at least one object-ball.

Additionally, it provides such a system wherein such at least one playing surface comprises at least one raised perimeter cushion structured and arranged to assist in maintaining the at least one billiard ball within such at least one playing surface. Also, it provides such a system wherein such at least one playing surface comprises a generally L-shaped configuration. In addition, it provides such a system wherein such at least one playing surface comprises a generally L-shaped configuration. And, it provides such a system wherein: such at least one playing surface comprises at least one raised perimeter cushion structured and arranged to assist in maintaining the at least one billiard ball within such at least one playing surface; such at least one perimeter cushion comprises at least eight substantially linear cushion segments structured and arranged to define at least six perimeter corners; such at least one first set of ball pockets and such at least one second set of ball pockets together comprise at least eight ball pockets located generally adjacent such at least six perimeter corners.

Further, it provides such a system wherein at least five of such at least six perimeter corners comprise ninety-degree corners. Even further, it provides such a system wherein: such at least one playing surface comprises at least one first playing surface area and at least one second playing surface area; and such at least one first set of ball pockets are located along such at least one first playing surface area. Even further, it provides such a system wherein: such at least one first set of ball pockets comprises four ball pockets of such at least eight ball pockets; and such at least one second set of ball pockets comprises four ball pockets of such at least eight ball pockets. Even further, it provides such a system wherein: such at least one first playing surface area comprises a maximum width of about 44 inches and a maximum width of about 88 inches; and such at least one second playing surface area comprises a maximum width of about 44 inches and a maximum width of about 88 inches.

Even further, it provides such a system wherein: such at least one playing surface comprises at least one supportive base frame structured and arranged to support such at least one playing surface over at least one floor surface; and such at least one supportive base frame is structured and arranged to support such at least one playing surface at a height above the at least one floor surface ranging between about 29 inches and about 31 inches.

In accordance with another preferred embodiment hereof, this invention provides a system related to billiard table constructions supporting billiard-type game play using at least one cue-ball and at least one object-ball, such system comprising: at least one playing surface structured and arranged to support the billiard-type game play using the at least one cue-ball and at least one object-ball; at least one first ball-pocket structured and arranged to receive the at least one cue-ball and at least one object-ball from such at least one playing surface; at least one second ball pocket structured and arranged to receive the at least one cue-ball and at least one object-ball from such at least one playing surface; at least one automatic cue-ball return structured and arranged to return the at least one cue-ball and at least one object-ball pocketed within such at least one first ball-pocket and such at least one second ball-pocket during play; wherein such at least one automatic cue-ball return comprises at least one cue-ball separator structured and arranged to separate the at least one cue-ball from the at least one object-ball; wherein such at least one cue-ball separator comprises at least one first cue-ball return path structured and arranged to return the at least one cue-ball to at least one first user-accessible position generally adjacent such at least one first ball-pocket; wherein such at least one cue-ball separator further comprises at least one second cue-ball return path structured and arranged to return the at least one cue-ball to at least one second user-accessible position generally adjacent such at least one second ball-pocket. Even further, it provides such a system wherein such at least one playing surface comprises a generally L-shaped configuration.

In accordance with another preferred embodiment hereof, this invention provides a system related to billiard table constructions supporting billiard-type game play using at least one cue-ball and at least one object-ball, such system comprising: playing surface means for supporting the billiard-type game play using the at least one cue-ball and at least one object-ball; first pocket receiver means for receiving the at least one cue-ball and at least one object-ball from such playing surface means; second pocket receiver means for receiving the at least one cue-ball and at least one object-ball from such playing surface means; automatic cue-ball return means for returning the at least one cue-ball and at least one object-ball pocketed within such first pocket receiver means and such second pocket receiver means during play; wherein such automatic cue-ball return means comprises cue-ball separator means for separating the at least one cue-ball from the at least one object-ball; wherein such cue-ball separator means comprises first cue-ball returning means for returning the at least one cue-ball to at least one first user-accessible position generally adjacent such first pocket receiver means; wherein such cue-ball separator means further comprises second cue-ball returning means for returning the at least one cue-ball to at least one second user-accessible position generally adjacent such first pocket receiver means. In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figures 1, 1A:
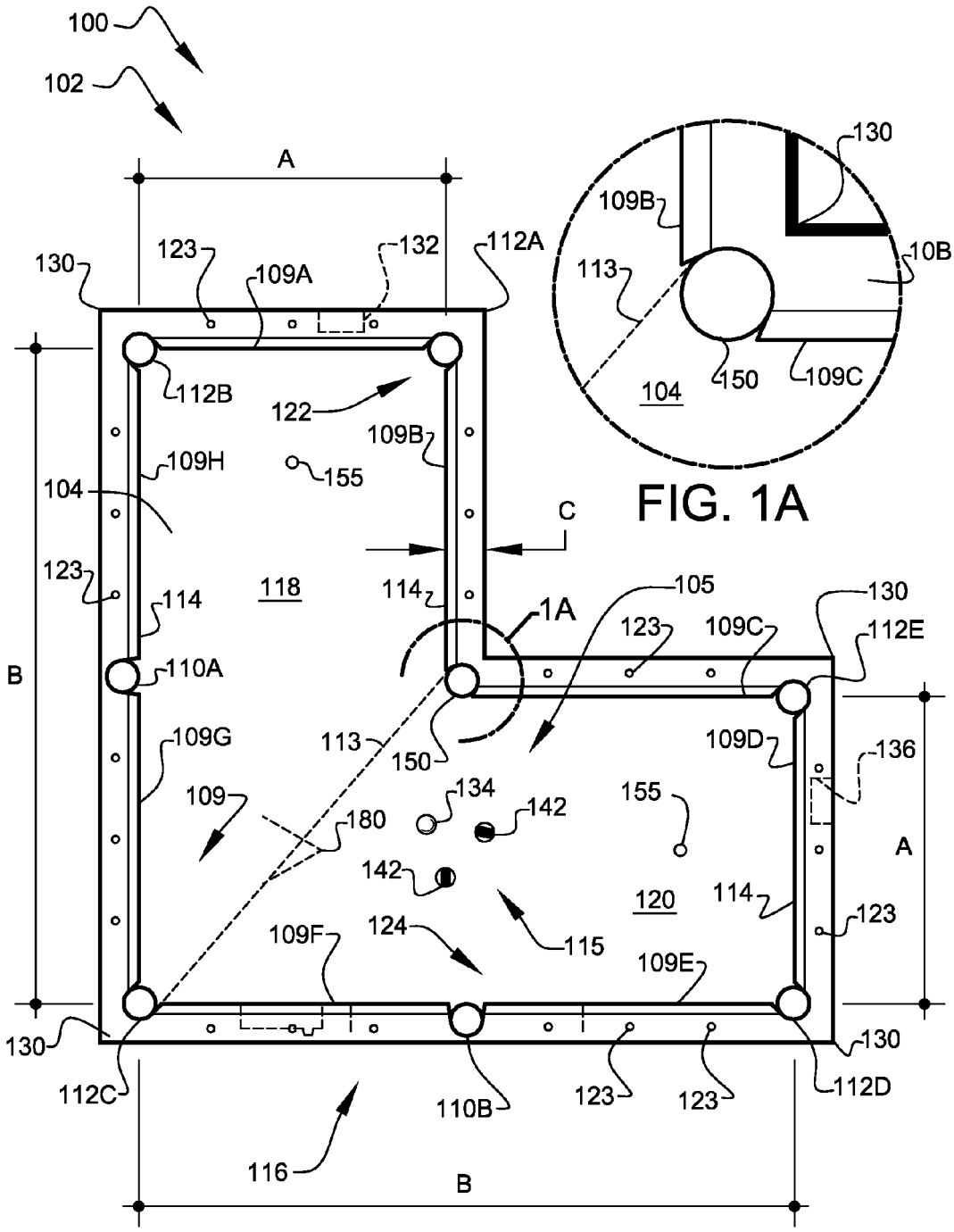
FIG. 1 shows a plan view illustrating a billiard table according to a preferred embodiment of the present invention.
FIG. 1A shows a partial plan view, enlarged for magnification purposes, illustrating a preferred ball-pocket configuration of the billiard table, according to the preferred embodiment of FIG. 1.

FIG. 1 shows a plan view illustrating billiard table 102 according to a preferred embodiment of the present invention. Preferably, billiard table 102, as shown in FIG. 1, comprises a preferred embodiment of billiards system 100. Preferably, billiard table 102 comprises four principal components. These components preferably comprise play surface assembly 105, preferably perimeter rail assembly 116, preferably base assembly 107 (see FIG. 2), and preferably automatic ball return assembly 117 (see FIG. 5). Preferably, the components are structured and arranged to be easily assembled and disassembled in order, for example, that regular service work on the various components can be performed as needed. Preferably, the above-described components are fastened together using removable fasteners to allow such easy assembly and disassembly.

Preferably, play surface assembly 105 is structured and arranged to support billiards-type game play using one or more billiards balls 115. Preferably, play surface assembly 105 (at least embodying herein playing surface means for supporting the billiard-type game play using the at least one cue-ball and the at least one object-ball) is non-rectangular, preferably comprising a non-traditional play-surface arrangement, as shown. Preferred configurations of play surface assembly 105 generally comprise substantially symmetrical layouts (in the example embodiment of FIG. 1, play surface assembly 105 is generally symmetrical about diagonal string line 113), as shown. The most preferred configuration of play surface assembly 105 comprises an L-shaped play area, as shown. Upon reading the teachings of this specification, those of ordinary skill in the art will now understand that, under appropriate circumstances, considering such issues as intended use, user/market preference, etc., other play-surface arrangements, such as cruciform shaped, star shaped, radially symmetric designs, etc., may suffice.

The preferred L-shaped configuration of play surface assembly 105 produces two playing regions identified herein as first playing-surface region 118 and second playing-surface region 120, as shown. First playing-surface region 118 preferably comprises the playing-surface area to the left of diagonal string line 113 (as shown in the depiction of FIG. 1). Second playing-surface region 120 preferably occupies the playing-surface area to the right of diagonal string line 113, as shown. Preferably, first playing surface region 118 comprises a maximum width A of about 44 inches and a maximum length B of about 88 inches, as shown. Similarly, second playing surface region 120 comprises a maximum width A of about 44 inches and a maximum length B of about 88 inches, as shown.

Preferably, a first set of ball pockets 122 (at least embodying herein first pocket receiver means for receiving the at least one cue-ball and the at least one object-ball from said playing surface means) are located about the periphery of first playing-surface region 118, as shown. Most preferably, first playing-surface region 118 comprises four ball pockets identified herein as inside-corner pocket 112A, inside-corner pocket 112B, inside-corner pocket 112C, and side pocket 110A, as shown.

Preferably, a second set of ball pockets 124 (at least embodying herein second pocket receiver means for receiving the at least one cue-ball and the at least one object-ball from said playing surface means) are located about the periphery of second playing-surface region 120, as shown. Most preferably, second playing-surface region 120 comprises four ball pockets identified herein as side pocket 110B, inside-corner pocket 112D, inside-corner pocket 112E, and outside-corner pocket 150, as shown. These ball pockets preferably function to receive billiard balls 115 "pocketed" during play.

Preferably, first playing-surface region 118 and second playing-surface region 120 share a common playing surface identified herein as playing surface 104. Preferably, playing surface 104 comprises a generally horizontal and rigid substrate material having a cloth covering (also referred to as the table bed). The substrate material of playing surface 104 preferably comprises a substantially solid and planar material with slate being most preferred. The preferred thickness of the slate is at least about 1 inch [about 2.5 cm] to assist in maintaining an acceptable overall level of flatness and to limit deflection to customary play tolerances.

Preferably, the peripheral edges of playing surface 104 are bounded by perimeter rail assembly 116, as shown. Preferably, perimeter rail assembly 116 is adapted to assist in maintaining the billiards balls 115 within playing surface 104, as shown. Preferably, perimeter rail assembly 116 comprises perimeter rail 108 and perimeter cushion 106, as shown. Perimeter rail 108 preferably functions to support perimeter cushion 106 that is preferably mounted horizontally on the playing-surface side of perimeter rail 108, as shown. The perpendicular width C of perimeter rail 108 is preferably between about 4 inches [about 10 cm] and about 7½ inches [about 19 cm] (including elastic bumper 114), as shown. Preferably, perimeter rail assembly 116 makes at least six directional changes at six peripheral corners, preferably six ninety-degree corners 130, as shown.

Preferably, perimeter cushion 106 is divided by the above-described ball pockets into eight substantially linear cushion segments 109 identified individually as cushion segment 109A, cushion segment 109B, cushion segment 109C, cushion segment 109D, cushion segment 109E, cushion segment 109F, cushion segment 109G, and cushion segment 109H, as shown. Preferably, each cushion segment 109 comprises a generally triangular elastic bumper 114 from which billiard balls 115 rebound during play. Each cushion segment 109 is preferably constructed from cloth-covered resilient material, preferably natural rubber, alternately preferably synthetic rubber. Preferably, each cushion segment 109 comprises a width between about 1⅞ [4.8 cm] and about 2 inches [5.4 cm] as measured from the meeting line with perimeter rail 108. Preferably, the "rail height" (nose-line of cushion 106 to playing surface 104) is preferably between about 62½ percent and about 64½ percent of the diameter of a billiard ball 115. Most preferably, each cushion segment 109 is molded with a standardized "K-66" profile, generally recognized by those skilled in the art, having a preferred base dimension of about 1 3/16 inch and a nose height of about 1 inch.

Preferably, perimeter rails 108 comprise an arrangement of inlays or markings identified herein as sights 123 that are preferably used as reference or target points during play. Preferably, billiard table 102 comprises 24 sights (or 23 and a nameplate), as shown. Preferably, each sight 123 is attached substantially flush with perimeter rail 108. A sight-to-sight spacing of about 11½ inches [29.2 cm] is most preferred. The center of each sight 123 is preferably located about 3 11/16 inches [93.7 m] from the nose of perimeter cushion 106. Preferably, sights 123 are diamond-shaped or alternately preferably round in shape, as shown.

Figure 2:
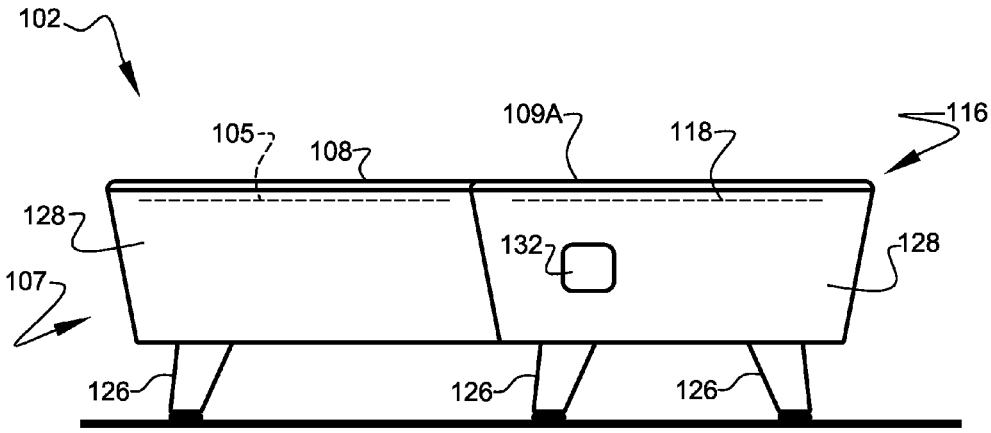
FIG. 2 shows a first end view of the billiard table according to the preferred embodiment of FIG. 1.
Figure 3:
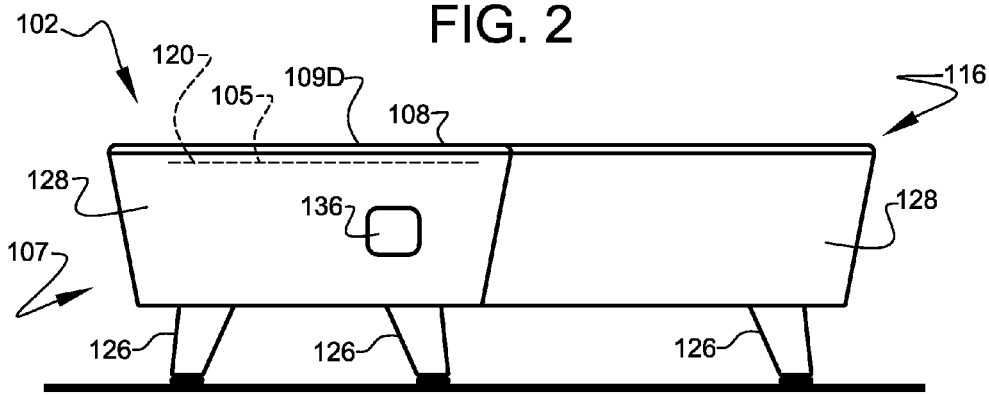
FIG. 3 shows a second end view of the billiard table according to the preferred embodiment of FIG. 1.
Figure 4:
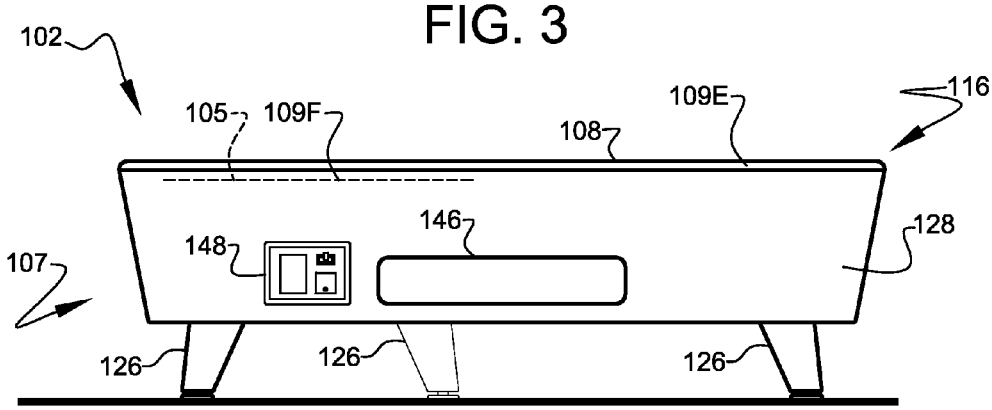
FIG. 4 shows a side view of the billiard table according to the preferred embodiment of FIG. 1.

FIG. 2 shows a first end view of billiard table 102 with FIG. 3 showing the opposite end view of billiard table 102, according to the preferred embodiment of FIG. 1. FIG. 4 shows a side view of billiard table 102 according to the preferred embodiment of FIG. 1.

Preferably, play surface assembly 105 is supported on a floor-standing frame structure identified herein as base assembly 107, as shown. Base assembly 107 preferably comprises a rigid structural framework supported by a set of leg members 126, as shown. Preferably, play surface assembly 105 is attached onto base assembly 107 by mechanical fastening, preferably using bolts or alternately preferably screws.

Preferably, perimeter rail assembly 116 comprises the upper perimeter rail 108, preferably running substantially continuously along the periphery of play surface assembly 105, preferably adjoining a perimeter of flanking side aprons 128, as shown. Preferably, perimeter rail assembly 116 sits on the top of play surface assembly 105 and is attached firmly to play surface assembly 105 with mechanical fasteners, most preferably by bolting.

Preferably, the first set of ball pockets 122 and second set of ball pockets 124 are firmly mounted to perimeter rail assembly 116, and, as may now be appreciated by those skilled in the art, may preferably function to hold perimeter rail 108 together at corners 130.

Preferably, the ball-pocket openings for both the first set of ball pockets 122 and the second set of ball pockets 124 generally conform to World Pool-Billiard Association (WPA) guidelines for physical configuration (the exception being the outside-corner pocket 150). These rules comprise a readily available public resource published through, for example, the World Pool-Billiard Association website (URL http://www-.wpa-pool.com).

Preferably, ball-pocket openings are measured at two points, the first being measured between opposing noses of perimeter cushion 106, where the direction of the cushion turns into the pocket (tip to tip). This is opening shall be referred to herein as the "mouth". The second point of measurement is taken at the narrowest point at the back of the pocket. This is opening shall be referred to herein as the "throat".

Preferably, corner pockets (excluding outside-corner pocket 150) comprise a "mouth" dimension ranging between about 4⅞ inches minimum to about 5⅛ inches maximum. Preferably, all corner pockets comprise a "throat" dimension ranging between about 4 inches minimum to about 4¼ inches maximum.

Side pockets preferably comprise a "mouth" dimension ranging between about 5⅜ inches minimum to about 5⅝ inches maximum. Preferably, side pockets comprise a "throat" dimension ranging between about 4⅜ inches minimum to 4⅞ inches maximum.

The ball-pocket shelf is preferably defined as the distance taken from the center of an imaginary line that extends across the ball-pocket "mouth" (at the points where the nose of perimeter cushion 106 changes direction) to the center of the vertical cut of the ball-pocket radius within playing surface 104. The ball-pocket "shelf" for corner pockets (excluding outside-corner pocket 150) preferably range between about 1⅝ inches minimum to about 1⅞ inches maximum. The ball-pocket "shelf" for side pockets preferably range between about 0 inches minimum to about ⅜ inch maximum.

The preferred drop-point slate radius for billiard table 102 (defined herein as the pocket radius measured from the vertical cut of the slate to the playing surface) is preferably between about a ⅛ inch radius minimum to about a ¼ inch radius maximum.

Preferably, outside-corner pocket 150 is located such that outer circumference of the pocket is approximately tangential to both a vertical plane extending along the nose of cushion segment 109B and a vertical plane extending along the nose of cushion segment 109C. The preferred end terminations of cushion segment 109B and cushion segment 109C are generally depicted in the enlarged detail of FIG. 1A. Upon reading the teachings of this specification, those of ordinary skill in the art will now understand that, under appropriate circumstances, considering such issues as intended use, cost, user preference, etc., other pocket arrangements, such as the addition of pocket liners to reduce pocket wear, alternate pocket shapes, positions, numbers of pocket, etc., may suffice.

Preferably, side aprons 128 of perimeter rail assembly 116 comprise a number of functional openings, as shown in FIG. 2 through FIG. 4. FIG. 2 shows a preferred position of first ball-return receptacle 132 (an opening on the side of billiard table 102) preferably located within the side apron adjacent first playing-surface region 118, more preferably within side apron 128 below cushion segment 109A, as shown. Preferably, first ball-return receptacle 132 is structured and arranged to hold a billiard ball, most preferably a cue ball 134 that has been returned by automatic ball return assembly 117 (see FIG. 5) after being pocketed within one of the ball pockets of the first set of ball pockets 122. Preferably, first ball-return receptacle 132 comprises a recessed bin adapted to hold cue ball 134 in at least one user-accessible position adjacent first playing-surface region 118, as shown.

FIG. 3 shows a preferred position of second ball-return receptacle 136 preferably located within a side apron adjacent second playing-surface region 120, more preferably within side apron 128 below cushion segment 109D, as shown. Preferably, second ball-return receptacle 136 is structured and arranged to hold a billiard ball, most preferably a cue ball 134 that has been returned by automatic ball return assembly 117 after being pocketed within one of ball pockets of the second set of ball pockets 122. Preferably, second ball-return receptacle 136 comprises a recessed bin adapted to hold cue ball 134 in at least one user-accessible position adjacent second playing-surface region 120, as shown.

Billiard table 102 is preferably configured to operated in a commercial environment, such as a bar, game hall, etc., wherein a user performs at least one monetary exchange to gain use of the table. Preferably, billiard table 102 is adapted to retain object balls 142 pocketed during play. More specifically, billiard table 102 is constructed to retain object balls 142 pocketed within the first set of ball pockets 122 and second set of ball pockets 124 in at least one user-inaccessible location within the table, most preferably within an internal compartment identified herein as third ball-return receptacle 144 (see also FIG. 5). Preferably, billiard table 102 is provided with ball dispenser assembly 200 for dispensing object balls 142 from third ball-return receptacle 144 to a user-accessible ball tray 146 at the beginning of play (at least embodying herein at least one controllable access structured and arranged to provide to the user, controllable access to the at least one billiards ball held within such at least one third ball-return receptacle). Preferably, ball dispenser assembly 200 comprises at least one monetary acceptor device 148 structured and arranged to initiate the ball-release operation on completion of at least one monetary exchange or other appropriate authorization. Preferably, monetary acceptor device 148 comprises a "coin-operated" device capable of receiving coins, as shown. In the present disclosure, the term "coin-operated" shall include in its definition, apparatus capable of receiving coins, paper bills, tokens, etc. Upon reading the teachings of this specification, those of ordinary skill in the art will now understand that, under appropriate circumstances, considering such issues as intended use, prevailing means of monetary exchange, advances in technology, etc., other payment arrangements, such as apparatus supporting credit/debit card-based transactions, apparatus supporting wireless transactions, etc., may suffice.

Preferably, ball tray 146 and ball dispenser assembly 200 are located within the long side apron 128 extending along (below) cushion segment 109E and cushion segment 109F, as shown.

Preferably, base assembly 107 is adapted to support playing surface 104 above floor surface 111 at a vertical distance of between about 29¼ inches [about 74 cm] and about 31 inches [about 79 cm]. Preferably, base assembly 107 is further adapted to support automatic ball return assembly 117 as illustrated in FIG. 5.

Figure 5:
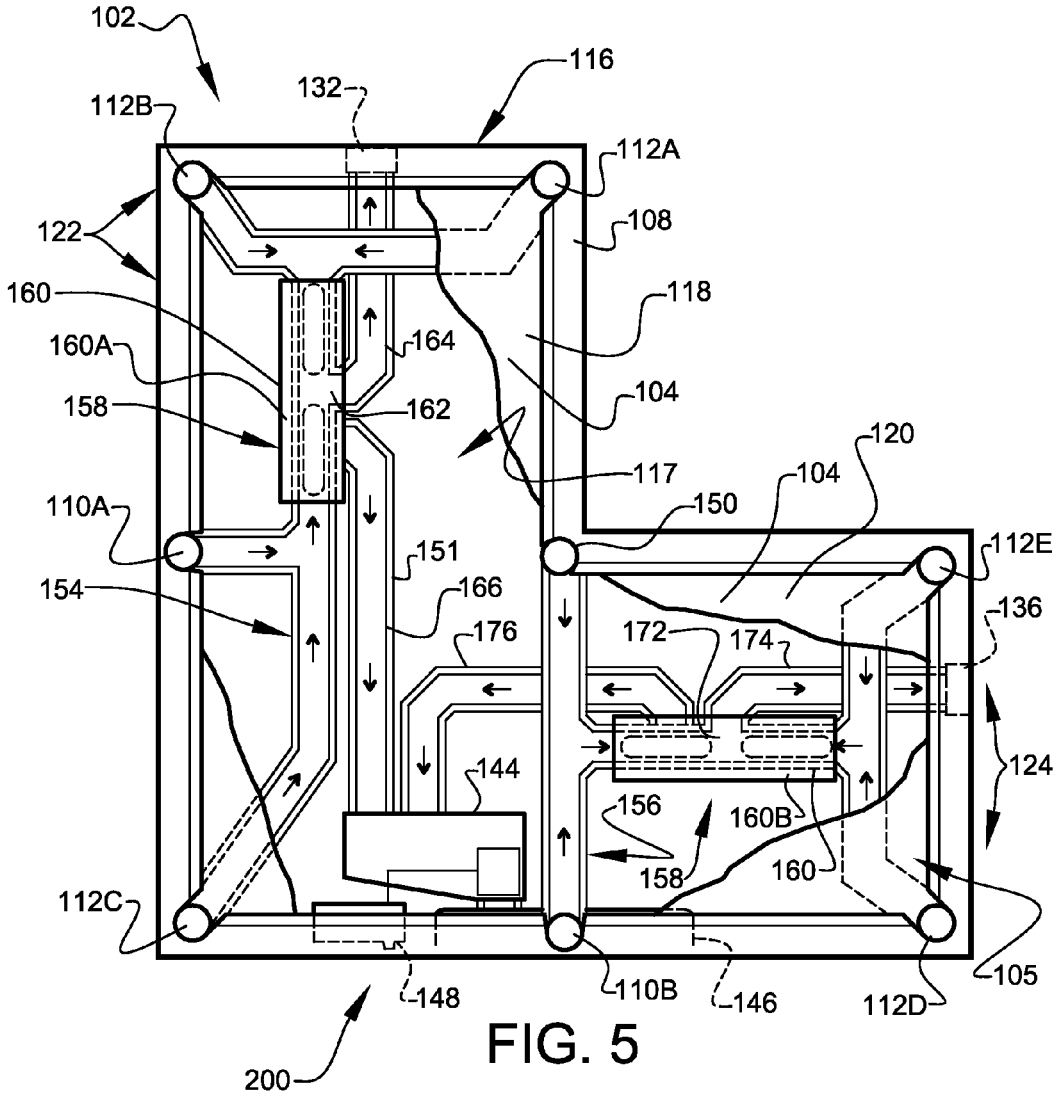
FIG. 5 shows a plan view, partially in section, illustrating an automatic ball return according to the preferred embodiment of FIG. 1.

FIG. 5 shows a plan view, partially in section, illustrating automatic ball return assembly 117 according to the preferred embodiment of FIG. 1. As previously described, if a player accidentally pockets cue ball 134 during play (an act known as a scratch), billiard table 102 is preferably designed to return cue ball 134 to a player-accessible location to allow play to proceed. Preferably, automatic ball return assembly 117 comprises at least one means for returning a pocketed cue ball 134 to either first ball-return receptacle 132 or second ball-return receptacle 136. The selection of ball-return receptacle during a ball-return operation is preferably based on the proximity of the ball-return receptacle to the pocket in which the ball has dropped. This preferred convenience feature assists users of the larger non-traditionally-shaped table during play.

Preferably, automatic ball return assembly 117 (at least embodying herein automatic cue-ball return means for returning the at least one cue-ball and the at least one object-ball pocketed within said first pocket receiver means and said second pocket receiver means during play) comprises a system of sloped internal runways 151 adapted to guide the pocketed billiard balls 115 between the ball pockets and their proper terminal destinations. The general direction of ball travel is graphically indicated by arrows depictions. Preferably, internal runways 151 occupy the area generally below play surface assembly 105 and within side aprons 128, as shown.

Preferably, automatic ball return assembly 117 comprises first ball-return path 154 (at least embodying herein wherein said cue-ball separator means comprises first cue-ball returning means for returning the at least one cue-ball to at least one first user-accessible position generally adjacent said first pocket receiver means) preferably designed to return cue ball 134 to first ball-return receptacle 132 after being pocketed within one of the first set of ball pockets 122, as shown. Preferably, automatic ball return assembly 117 further comprises second ball-return path 156 (at least embodying herein wherein said cue-ball separator means further comprises second cue-ball returning means for returning the at least one cue-ball to at least one second user-accessible position generally adjacent said first pocket receiver means) functioning to return cue ball 134 to second ball-return receptacle 136 after being deposited within one of the such first set of ball pockets to such at least one second ball-return receptacle.

Generally stated, first ball-return path 154 and second ball-return path 156 preferably comprise at least one ball-separator assembly 158 structured and arranged to separate cue-ball 134 from the object-balls 142 during return operations, as shown. More preferably, first ball-return path 154 and second ball-return path 156 each comprise a dedicated ball-separator assembly 158 (at least embodying herein wherein said automatic cue-ball return means comprises cue-ball separator means for separating the at least one cue-ball from the at least one object-ball), function as described above. Preferably, each ball-separator assembly 158 comprises at least one ball diverter 160 functioning to divert object-balls 142 to third ball-return receptacle 144 and the cue ball 134 to its intended ball-return receptacle. The following describes, in greater detail, the preferred arrangements of first ball-return path 154 and second ball-return path 156.

It is preferred that first ball-return path 154 comprise first junction 162 structured and arranged to divide first ball-return path 154 into at least one first cue-ball path 164 (preferably communicating with first ball-return receptacle 132) and at least one first object-ball path 166 (preferably communicating with third ball-return receptacle 144), as shown. Preferably, first junction 162 comprises first ball-diverter 160A structured and arranged to divert cue-ball 134 to first cue-ball path 164 and object-balls 142 to first object-ball path 166, as shown.

Similarly, it is preferred that second ball-return path 156 comprise second junction 172 structured and arranged to divide second ball-return path 156 into at least one second cue-ball path 174 (preferably communicating with second ball-return receptacle 136) and at least one second object-ball path 176 (preferably communicating with third ball-return receptacle 144), as shown. Preferably, second junction 172 comprises second ball-diverter 160B structured and arranged to divert cue-ball 134 to second cue-ball path 174 and object-balls 142 to second object-ball path 176, as shown. Preferably, third ball-return receptacle 144 comprises a capacity sufficient to hold at least fifteen object-balls 142.

Preferably, each ball-separator assembly 158 operates by sorting cue balls 134 imparted with specific physical properties. Preferably, each ball-separator assembly 158 operates using at least one of the following two methods.

In a first preferred method, ball-separator assembly 158 utilizes an oversized cue ball that is separated from object balls 142 by at least one diameter-gauging operation of ball diverter 160. The oversized cue ball 134 is approximately 2⅜ inches (6 cm) in diameter, which is about one-eighth of an inch (2 mm) larger than object balls 142. This minor difference in size allows cue ball 134 to be diverted to one of the user-accessible ball-return receptacles before it reaches the inaccessible third ball-return receptacle 144. The smaller object balls 142 are able to pass through the gauging mechanism of ball diverter 160 and are directed to third ball-return receptacle 144.

In a second alternate preferred method, ball-separator assembly 158 utilizes a magnetic cue ball 134 (comprising a magnetic core composition) that triggers a magnetic detector within an alternate ball diverter 160. As the magnetic cue ball 134 passes this detector, the magnet triggers ball diverter 160 to separate the magnetic cue ball 134 and, again, sends it into one of the user-accessible ball-return receptacles. The non-magnetic object balls 142 are able to pass through ball diverter 160 and are directed to the inaccessible third ball-return receptacle 144. Most preferably, billiard table 102 is adapted to use either sorting method interchangeably. Upon reading the teachings of this specification, those of ordinary skill in the art will now understand that, under appropriate circumstances, considering such issues as user preference, intended use, cost, advances in technology, etc., other sorting arrangements, such as optical-based detectors using color or reflectivity, weight-based sorting systems, sorting based on radio-frequency detection (RFID), etc., may suffice.

Preferably, playing surface 104 comprises surface indicia 155 to indicate the location of racking points, string lines, etc., as shown. A triangular billiards ball rack is preferably used to rack billiard balls 115 at the beginning of play. It is preferred that a complete set of billiard balls 115 consists of one white cue ball 134 and fifteen color-coded, numbered object balls 142. Preferably, the "apex" object ball 142 of the rack of object balls 142 is preferably "spotted" (located) on foot spot 180 (see again FIG. 1) that is generally adjacent diagonal string line 113, as shown. Preferably, the "apex" object ball 142 is oriented along a line bisecting the midpoint of cushion segments 109D, as shown. Upon reading the teachings of this specification, those of ordinary skill in the art will now understand that, under appropriate circumstances, considering such issues as user preference, preferred game play, intended use, development of alternate rules, etc., other arrangements, such as alternate numbers of billiard balls, alternate racking points, alternate methods of initiating a game, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system related to billiard table constructions supporting billiards-type game play using at least one billiard ball, said system comprising:

a) at least one playing surface, comprising at least one first playing-surface region and at least one second playing-surface region, said at least one first playing-surface region and said at least one second playing-surface region each structured and arranged to support the billiards-type game play using the at least one billiard ball;

b) disposed about said at least one first playing-surface region, at least one first set of ball pockets structured and arranged to receive the at least one billiard ball;

c) disposed about said at least one second playing-surface region, at least one second set of ball pockets structured and arranged to receive the at least one billiard ball;

d) at least one first ball-return receptacle structured and arranged to hold the at least one billiard ball in at least one user-accessible position adjacent said at least one first playing-surface region;

e) at least one second ball-return receptacle structured and arranged to hold the at least one billiard ball in at least one user-accessible position adjacent said at least one second playing-surface region;

f) at least one first ball-return path structured and arranged to return the at least one billiard ball pocketed within said first set of ball pockets to said at least one first ball-return receptacle; and g) at least one second ball-return path structured and arranged to return the at least one billiard ball pocketed within said second set of ball pockets to said at least one second ball-return receptacle h) wherein said at least one playing surface comprises a generally L-shaped configuration;

i) wherein said at least one playing surface comprises at least one raised perimeter cushion structured and arranged to assist in maintaining the at least one billiard ball within said at least one playing surface;

j) wherein said at least one perimeter cushion comprises at least eight substantially linear cushion segments structured and arranged to define at least six perimeter corners; and k) wherein said at least one first set of ball pockets and said at least one second set of ball pockets together comprise at least eight ball pockets located generally adjacent said at least six perimeter corners.

2. The system according to claim 1 further comprising:

a) at least one third ball-return receptacle structured and arranged to hold the at least one billiard ball in at least one user-inaccessible position;

b) wherein said at least one third ball-return receptacle comprises at least one controllable access structured and arranged to provide to the user, controllable access to the at least one billiard ball held within said at least one third ball-return receptacle.

3. The system according to claim 2 wherein:

a) such at least one billiard ball includes at least one cue-ball and at least one object-ball;

b) said at least one first ball-return path and said at least one second ball-return path comprise at least one ball-separator structured and arranged to separate the at least one cue-ball from the at least one object-ball; and c) said at least one ball-separator comprises at least one object-ball diverter structured and arranged to divert the at least one object-ball to said at least one third ball-return receptacle.

4. The system according to claim 2 wherein:

a) such at least one billiard ball includes at least one cue-ball and at least one object-ball;

b) said at least one first ball-return path comprises at least one first junction structured and arranged to divide said at least one first ball-return path into at least one first cue-ball path communicating with said at least one first ball-return receptacle and at least one first object-ball path communicating with said at least one third ball-return receptacle;

c) said at least one first junction comprises at least one first ball-diverter structured and arranged to divert the at least one cue-ball to said at least one first cue-ball path and the at least one object-ball to said at least one first object-ball path.

5. The system according to claim 4 wherein:

a) said at least one second ball-return path comprises at least one second junction structured and arranged to divide said at least one second ball-return path into at least one second cue-ball path communicating with said at least one second ball-return receptacle and at least one second object-ball path communicating with said at least one third ball-return receptacle;

b) said at least one second junction comprises at least one second ball-diverter structured and arranged to divert the at least one cue-ball to said at least one second cue-ball path and the at least one object-ball to said at least one second object-ball path.

6. The system according to claim 5 wherein said at least one controllable access comprises at least one monetary acceptor structured and arranged to allow user access to the at least one object-ball on completion of at least one monetary exchange.

7. The system according to claim 6 wherein said at least one third ball-return receptacle comprises at least one capacity sufficient to hold at least fifteen of the at least one object-balls.

8. The system according to claim 3 wherein:

a) the at least one object-ball comprises an outer diameter smaller than the outer diameter of the at least one cue-ball; and b) said at least one object-ball diverter comprises at least one ball-diameter gauge structured and arranged to divert the at least one object-ball by gauging the outer diameter of the at least one cue-ball.

9. The system according to claim 3 wherein:

a) the at least one cue-ball comprises at least one magnetic composition;

b) the at least one object-ball comprises at least one substantially non-magnetic composition;

c) said at least one object-ball diverter comprises at least one magnetic detector structured and arranged to detect the presence of the at least one magnetic composition; and d) said at least one magnetic detector is structured and arranged to pass the at least one cue-ball and to divert the at least one object-ball.

10. The system according to claim 1 wherein said at least one playing surface comprises at least one raised perimeter cushion structured and arranged to assist in maintaining the at least one billiard ball within said at least one playing surface.

11. The system according to claim 1 wherein at least five of said at least six perimeter corners comprise corners having an angle of about ninety degrees.

12. The system according to claim 1 wherein:

a) said at least one playing surface comprises at least one first playing surface area and at least one second playing surface area;

b) said at least one first set of ball pockets are located along said at least one first playing surface area; and c) said at least one second set of ball pockets are located along said at least one second playing surface area.

13. The system according to claim 12 wherein:

a) said at least one first set of ball pockets comprises four ball pockets of said at least eight ball pockets; and b) said at least one second set of ball pockets comprises four ball pockets of said at least eight ball pockets.

14. The system according to claim 12 wherein:

a) said at least one first playing surface area comprises a maximum width of about 44 inches and a maximum length of about 88 inches; and b) said at least one second playing surface area comprises a maximum width of about 44 inches and a maximum length of about 88 inches.

15. The system according to claim 14 wherein:

a) said at least one playing surface comprises at least one supportive base frame structured and arranged to support said at least one playing surface over at least one floor surface; and b) said at least one supportive base frame is structured and arranged to support said at least one playing surface at a height above the at least one floor surface ranging between about 29 inches and about 31 inches.

16. A system related to billiard table constructions supporting billiards-type game play using at least one cue-ball and at least one object-ball, said system comprising:

a) at least one playing surface structured and arranged to support the billiards-type game play using the at least one cue-ball and the at least one object-ball;

b) at least one first ball-pocket structured and arranged to receive the at least one cue-ball and at least one object-ball from said at least one playing surface;

c) at least one second ball pocket structured and arranged to receive the at least one cue-ball and the at least one object-ball from said at least one playing surface; and d) at least one automatic cue-ball return structured and arranged to return the at least one cue-ball and the at least one object-ball pocketed within said at least one first ball-pocket and said at least one second ball-pocket during play;

e) wherein said at least one automatic cue-ball return comprises at least one cue-ball separator structured and arranged to separate the at least one cue-ball from the at least one object-ball;

f) wherein said at least one cue-ball separator comprises at least one first cue-ball return path structured and arranged to return the at least one cue-ball pocketed within said at least one first ball-pocket to at least one first user-accessible position generally adjacent said at least one first ball-pocket; and g) wherein said at least one cue-ball separator further comprises at least one second cue-ball return path structured and arranged to return the at least one cue-ball pocketed within said at least one second ball-pocket to at least one second user-accessible position generally adjacent said at least one second ball-pocket.

17. The system according to claim 16 wherein said at least one playing surface comprises a generally L-shaped configuration.

18. A system related to billiard table constructions supporting billiards-type game play using at least one billiard ball, said system comprising:

a) at least one playing surface, comprising at least one first playing-surface region and at least one second playing-surface region, said at least one first playing-surface region and said at least one second playing-surface region each structured and arranged to support the billiards-type game play using the at least one billiard ball;

b) disposed about said at least one first playing-surface region, at least one first set of ball pockets structured and arranged to receive the at least one billiard ball;

c) disposed about said at least one second playing-surface region, at least one second set of ball pockets structured and arranged to receive the at least one billiard ball;

d) at least one first ball-return receptacle structured and arranged to hold the at least one billiard ball in at least one user-accessible position adjacent said at least one first playing-surface region;

e) at least one second ball-return receptacle structured and arranged to hold the at least one billiard ball in at least one user-accessible position adjacent said at least one second playing-surface region;

f) at least one first ball-return path structured and arranged to return the at least one billiard ball pocketed within said first set of ball pockets to said at least one first ball-return receptacle;

g) at least one second ball-return path structured and arranged to return the at least one billiard ball pocketed within said second set of ball pockets to said at least one second ball-return receptacle; and h) at least one third ball-return receptacle structured and arranged to hold the at least one billiard ball in at least one user-inaccessible position;

i) wherein said at least one third ball-return receptacle comprises at least one controllable access structured and arranged to provide to the user, controllable access to the at least one billiard ball held within said at least one third ball-return receptacle;

j) wherein such at least one billiard ball includes at least one cue-ball and at least one object-ball;

k) wherein said at least one first ball-return path and said at least one second ball-return path comprise at least one ball-separator structured and arranged to separate the at least one cue-ball from the at least one object-ball;

l) wherein said at least one ball-separator comprises at least one object-ball diverter structured and arranged to divert the at least one object-ball to said at least one third ball-return receptacle;

m) wherein the at least one object-ball comprises an outer diameter smaller than the outer diameter of the at least one cue-ball; and n) wherein said at least one object-ball diverter comprises at least one ball-diameter gauge structured and arranged to divert the at least one object-ball by gauging the outer diameter of the at least one cue-ball.

19. A system related to billiard table constructions supporting billiards-type game play using at least one billiard ball, said system comprising:

a) at least one playing surface, comprising at least one first playing-surface region and at least one second playing-surface region, said at least one first playing-surface region and said at least one second playing-surface region each structured and arranged to support the billiards-type game play using the at least one billiard ball;

b) disposed about said at least one first playing-surface region, at least one first set of ball pockets structured and arranged to receive the at least one billiard ball;

c) disposed about said at least one second playing-surface region, at least one second set of ball pockets structured and arranged to receive the at least one billiard ball;

d) at least one first ball-return receptacle structured and arranged to hold the at least one billiard ball in at least one user-accessible position adjacent said at least one first playing-surface region;

e) at least one second ball-return receptacle structured and arranged to hold the at least one billiard ball in at least one user-accessible position adjacent said at least one second playing-surface region;

f) at least one first ball-return path structured and arranged to return the at least one billiard ball pocketed within said first set of ball pockets to said at least one first ball-return receptacle;

g) at least one second ball-return path structured and arranged to return the at least one billiard ball pocketed within said second set of ball pockets to said at least one second ball-return receptacle; and h) at least one third ball-return receptacle structured and arranged to hold the at least one billiard ball in at least one user-inaccessible position;

i) wherein said at least one third ball-return receptacle comprises at least one controllable access structured and arranged to provide to the user, controllable access to the at least one billiard ball held within said at least one third ball-return receptacle;

j) wherein such at least one billiard ball includes at least one cue-ball and at least one object-ball;

k) wherein said at least one first ball-return path and said at least one second ball-return path comprise at least one ball-separator structured and arranged to separate the at least one cue-ball from the at least one object-ball;

l) wherein said at least one ball-separator comprises at least one object-ball diverter structured and arranged to divert the at least one object-ball to said at least one third ball-return receptacle;

m) wherein the at least one cue-ball comprises at least one magnetic composition;

n) wherein the at least one object-ball comprises at least one substantially non-magnetic composition;

o) wherein said at least one object-ball diverter comprises at least one magnetic detector structured and arranged to detect the presence of the at least one magnetic composition; and p) wherein said at least one magnetic detector is structured and arranged to pass the at least one cue-ball and to divert the at least one object-ball.

* * * * *